US005121696A

United States Patent [19]

Harder

[11] Patent Number: 5,121,696

[45] Date of Patent: Jun. 16, 1992

[54] PACKING PALLET

[75] Inventor: Melvin S. Harder, Sunnyvale, Calif.

[73] Assignee: ROLM Systems, Santa Clara, Calif.

[21] Appl. No.: 609,943

[22] Filed: Nov. 6, 1990

[51] Int. Cl.[5] ..... B65D 19/26

[52] U.S. Cl. ..... 108/51.3; 248/633; 108/51.1

[58] Field of Search ..... 108/55.1, 55.3, 55.5, 108/51.1, 51.3; 248/633 X

[56] References Cited

U.S. PATENT DOCUMENTS

| | | | |
|---|---|---|---|
| 3,104,085 | 9/1963 | Skladany | 108/55.5 X |
| 3,833,138 | 9/1974 | Dean | 108/51.1 X |
| 4,116,344 | 9/1978 | Ziemba | 108/51.3 X |
| 4,159,681 | 7/1979 | Vandament | 108/51.1 |
| 4,293,605 | 10/1981 | Persson et al. | 108/51.3 X |
| 4,295,431 | 10/1981 | Stavlo | 108/55.1 |
| 4,717,025 | 1/1988 | Maurer | 108/51.3 |

FOREIGN PATENT DOCUMENTS

| | | | |
|---|---|---|---|
| 971116 | 7/1975 | Canada | 108/51.3 |

OTHER PUBLICATIONS

IBM Technical Disclosure Bulletin, T. J. Hasec et al, vol. 21, No. 10, Mar. 1979.

*Primary Examiner*—Peter A. Aschenbrenner
*Attorney, Agent, or Firm*—Michael B. Einschlag

[57] ABSTRACT

A packing pallet which provides increased buckle resistance for a given amount of cushioning material. In particular, an inventive packing pallet utilizes a stringer as a bottom support for cushions and a top deck board which is bolted, through the cushions, to the stringer.

7 Claims, 6 Drawing Sheets

190

PACKING PALLET

TECHNICAL FIELD OF THE INVENTION

The present invention pertains to a packing pallet for telecommunications equipment and, in particular, to a packing pallet for a telecommunications switch along with its accessories, line cords, publications, and spare parts.

BACKGROUND OF THE INVENTION

Packing pallets are used to ship equipment such as, for example, a telecommunications switch with its casters. Experience has taught that prior art packing pallets, such as that shown in FIG. 1, are unacceptable because they allow shock and vibration to be passed directly to the telecommunications equipment cabinet without proper protection. As a result, the use of such prior art packing pallets has caused a large incidence of damage to the equipment. This damage has, in turn, resulted in large extra expense due to the extra expense involved in: (a) repairing damaged equipment; (b) warehousing extra equipment for replacement purposes; and (c) additional shipping costs.

In addition, the use of prior art pallets like that shown in FIG. 1 led to the fact that accessory equipment, line cords, publications, spare parts and so forth were shipped in separate boxes. As a result, these materials often arrived at a customer's site at a different than the switch. As one can readily appreciate, this caused problems in that equipment assembly was often delayed.

In light of the above, there is a need in the art for a packing pallet that can handle a telecommunications switch along with its accessories, line cords, publications, and spare parts. Further, there is a need in the art for such a packing pallet which: (a) protects the equipment from shipment damage; (b) ensures that all of the equipment will arrive with the switch; (c) eliminates tip hazards during shipment; (c) increases the total weight of a unit load, which increase will reduce potential drop height during shipment; and (d) permits easy removal of the equipment from the pallet.

SUMMARY OF THE INVENTION

Embodiments of the present invention advantageously satisfy the above-identified need in the art and provide a packing pallet that can handle a telecommunications switch along with its accessories, line cords, publications, and spare parts. Further, an embodiment of the present invention is a packing pallet which: (a) protects the equipment from shipment damage; (b) ensures that all of the equipment will arrive with the switch; (c) eliminates tip hazards during shipment; (c) increases the total weight of a unit load, which increase reduces potential drop height during shipment; and (d) permits easy removal of the equipment from the pallet.

A ROLM Systems 9751 CBX (computerized business exchange) Model 10 is a mid-range Private Business Exchange telephone switch that is modular in design. The modular design allows the customer to order 1, 2, or 3 shelves of equipment, depending on the capacity that the customer requires. The assembled configurations represent the following weights: (a) one shelf - 152 lbs; (b) two shelves - 224 lbs; and (c) three shelves - 296 lbs. Advantageously, one embodiment of the present invention is a packing pallet for the 9751 CBX Model 10 which accommodates all three configuration of the CBX from the rigors of the distribution system. As one can readily appreciate, this is advantageous because the use of a single packing pallet to accommodate all three configurations eliminates two further pallets and their associated inventory, tracking, and purchasing administration overhead. Further, this embodiment of the inventive packing pallet protects the CPU assembly of the switching system, which assembly is disposed on the first shelf of the switching equipment, from feeling shocks larger than 15 g's. As those of ordinary skill in the art appreciate, this requirement enables one to protect equipment which is more fragile than an egg, an egg being able to withstand shocks as large as 25 g's.

Advantageously, an embodiment of the inventive packing pallet can support a unit of the above-described equipment on only 160 square inches of foam cushion, or less, without having the cushion buckle. This is important because, as those of ordinary skill in the art appreciate, buckling would cause the equipment to topple over.

In accordance with the inventive pallet, a stringer is used as a bottom support for cushions and a top deck board is bolted, through the cushions, to the stringer. As we have discovered, this arrangement, advantageously permits one to use 160 square inches of foam cushions to support one, two, or three shelves of the above-described equipment, thereby reducing the number of pallets required for shipment of the various configuration from three to one.

The above-described packing pallet has the following additional advantages: (a) accessories are loaded into a box that is placed on top of the cabinet and the box is then affixed to pallet by, for example, stretch wrapping the box to the cabinet—in this manner, the entire arrangement is shipped as a unit load and this ensures that the entire shipment will arrive at the customer's site at the same time; (b) embodiments having a built-in ramp provide for easy removal of equipment from the pallet; (c) corner posts and stretch wrap film may be used to hold equipment covers securely in place during shipment; and (d) the pallet may be fabricated so that its footprint is 24"×40", which footprint conforms to industry standard and, thereby, optimizes warehouse and trucking cube utilization.

BRIEF DESCRIPTION OF THE DRAWING

A complete understanding of the present invention may be gained by considering the following detailed description in conjunction with the accompanying drawing, in which.

DETAILED DESCRIPTION

Figure 1:
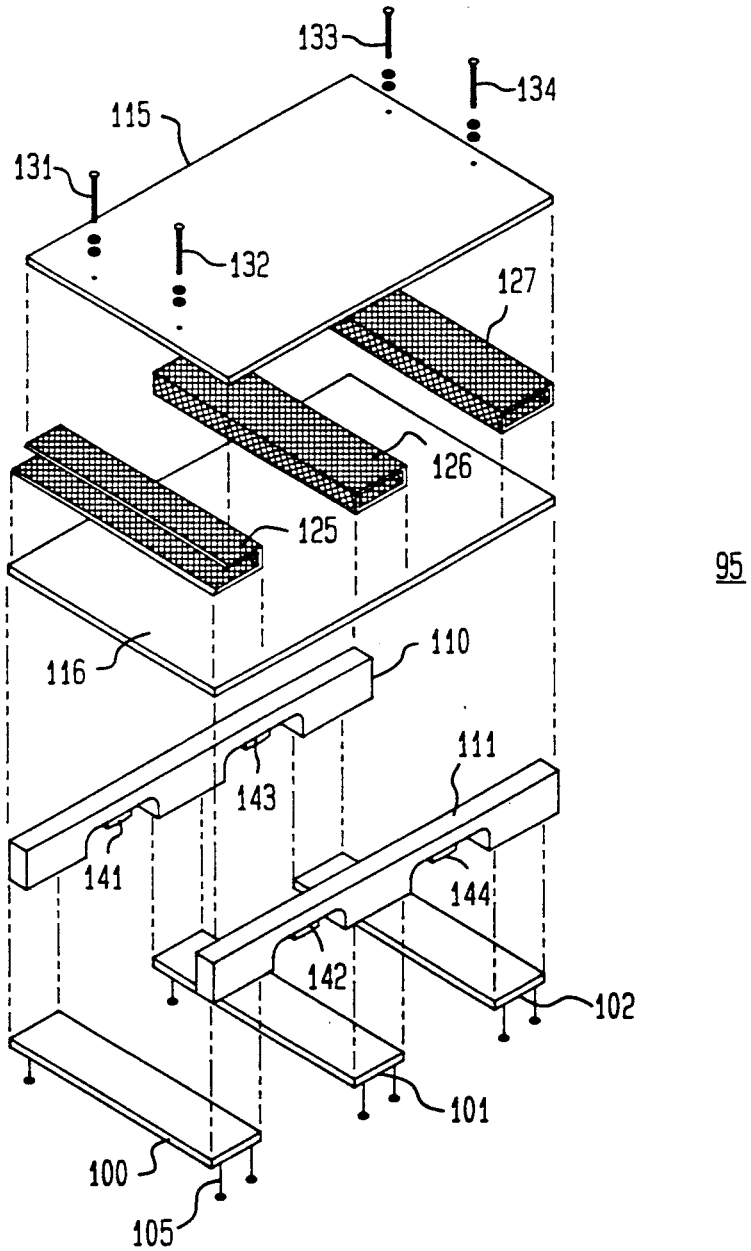
FIG. 1 shows, in pictorial form, an exploded isometric view of a prior art pallet.

FIG. 1 shows an exploded isometric view of prior art pallet 95. As shown in FIG. 1, bottom deck boards 100, 101, and 102 are nailed, using nails like nail 105, to stringers 110 and 111. Further, polyethylene cushions 125, 126, and 127 are sandwiched between top deck plywood slabs 115 and 116, respectively. Lastly, top deck slabs 115 and 116 are bolted to stringers 110 and 111 by pallet bolts 131, 132, 133, and 134 and their attendant lockwashers, washers, and T-Nuts. The pallet bolts are held in place by T-Nuts 141, 142, 143, and 144. As shown in FIG. 1, bolts 131-134 do not traverse cushions 125-127. The pallet shown in FIG. 1 has proven to be unsatisfactory in use. This is because prior art pallet 95 cannot support a sufficient weight without buckling to enable it to be used for more than one configuration of a ROLM Systems 9751 CBX (computerized business exchange) Model 10. A 9751 CBX Model 10 is a mid-range Private Business Exchange telephone switch that is modular in design. The modular design allows the customer to order 1, 2, or 3 shelves of equipment, depending on the capacity that the customer requires. The assembled configurations represent the following weights: (a) one shelf - 152 lbs; (b) two shelves - 224 lbs; and (c) three shelves - 296 lbs. As a result, more than one type of prior art pallet 95 is required to ship various models of the hardware.

Figure 2:
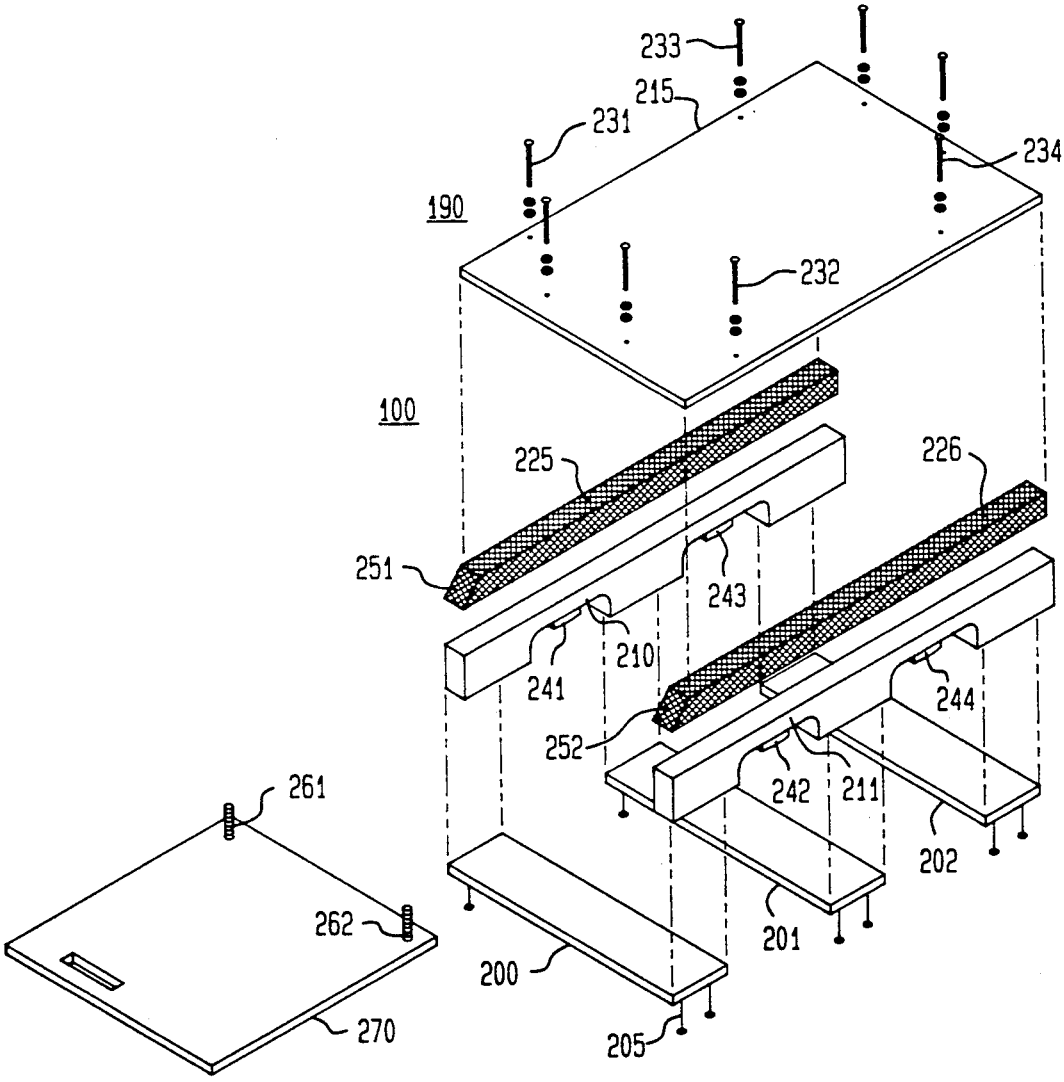
FIG. 2 shows, in pictorial form, an exploded isometric view of an embodiment of the present invention.

FIG. 2 shows an exploded isometric view of an embodiment of the present invention, i.e., inventive pallet 190 which accommodates all three configuration of 9751 CBX Model 10from the rigors of the distribution system. As shown in FIG. 2, bottom deck boards 200, 201, and 202 are nailed, using nails like nail 205, to stringers 210 and 211. Cushions 225 and 226 are disposed to cover the top of stringers 210 and 211, respectively. Cushions 225 and 226 are covered by top deck 215. Lastly, top deck 215 is bolted to stringers 210 and 211, through cushions 225 and 226, by pallet bolts 231, 232, 233, and 234 and their attendant lockwashers, washers, and T-Nuts. The pallet bolts are held in place by T-Nuts 241, 242, 243, and 244. We have found that above-described inventive packing pallet 190 is superior to prior art pallet 95 shown in FIG. 1 because pallet 190 provides superior resistance to buckling. As one can readily appreciate, this is advantageous because the use of the single packing pallet to accommodate all three configurations of 9751 CBX Model 10 eliminates two further pallets and their associated inventory, tracking, and purchasing administration overhead.

Further, as shown in FIG. 2, one end of cushions 225 and 226 are inclined and have holes 251 and 252, respectively, disposed therein. The holes are disposed to receive dowels 261 and 262 which are disposed in removable ramp 270. As will be readily appreciated by those of ordinary skill in the art, removable ramp 270 may be used to provide easy removal of equipment from the pallet. In a preferred embodiment of the present invention, removable ramp 270 is fabricated from, for example, ¾ inch plywood and dowels 261 and 262, for example, ⅜ inch wooden dowels having rounded ends, are sunk into ramp 270 and glued in place.

In a preferred embodiment of the present invention, cushions 225 and 226 are polyethylene foam. For assembly, it is preferred that polyethylene cushions 225 and 226 be glued to the top of stringers 210 and 211, respectively, and be glued to the bottom of top deck 215. Moreover, in a preferred embodiment, top deck 215 is formed from ¾ inch plywood; stringers 210 and 211 are formed from 2×4 inch board nominally; bottom deck boards 200, 201, and 202 are formed from 1×6 inch board nominally; and cushions 225 and 226 are formed from 4 lb. density polyethylene foam which is itself formed from environmentally acceptable blowing agents such as, for example, HCFC 142B or better.

Figure 3:
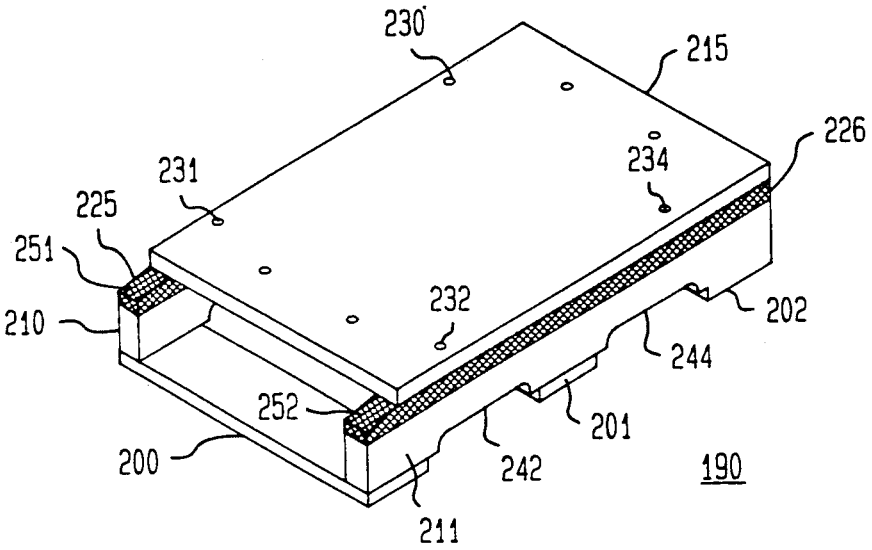
FIG. 3 shows, in pictorial form, an isometric view of the embodiment of the present invention shown in FIG. 2.
Figure 4:
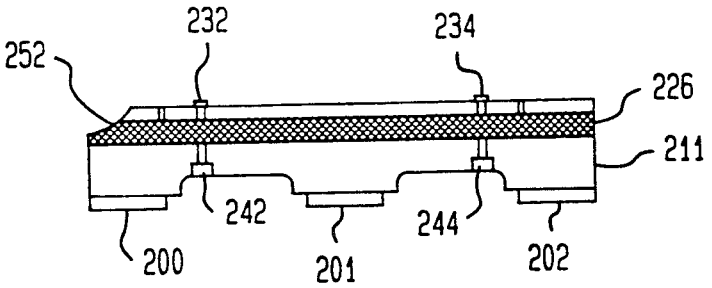
FIG. 4 shows, in pictorial form, a cross section of the embodiment of the present invention shown in FIG. 2.

FIG. 3 shows an isometric view of inventive pallet 190 and FIG. 4 shows a cross section of inventive pallet 190.

Figure 5:
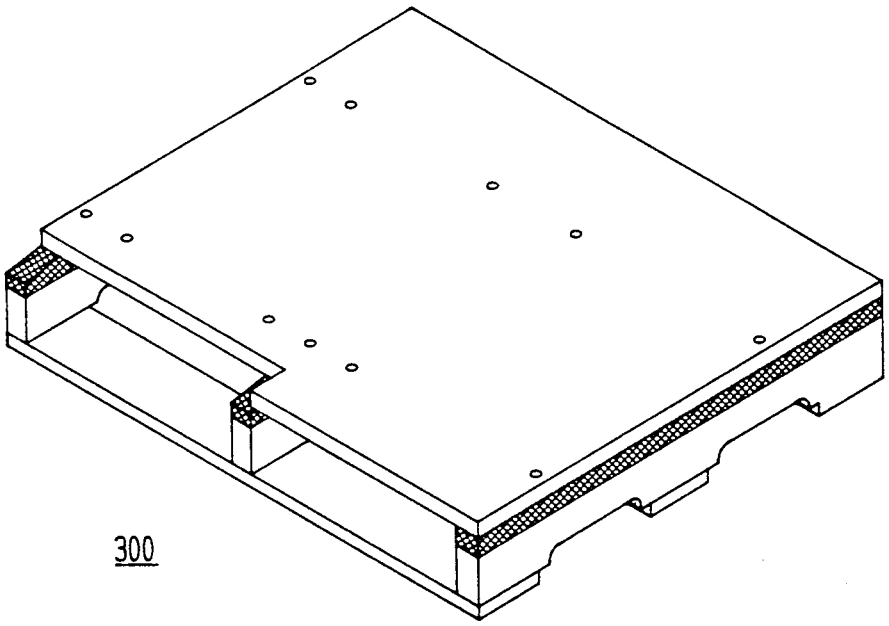
FIG. 5 shows, in pictorial form, an isometric view of a second embodiment of the present invention.

FIG. 5 shows an isometric view of a second embodiment of the present invention for use in transporting a different configuration of equipment, which pallet 300 is comprised of a first section having tapered ends for forming a ramp to deload equipment and a second section without a ramp.

Figure 6:
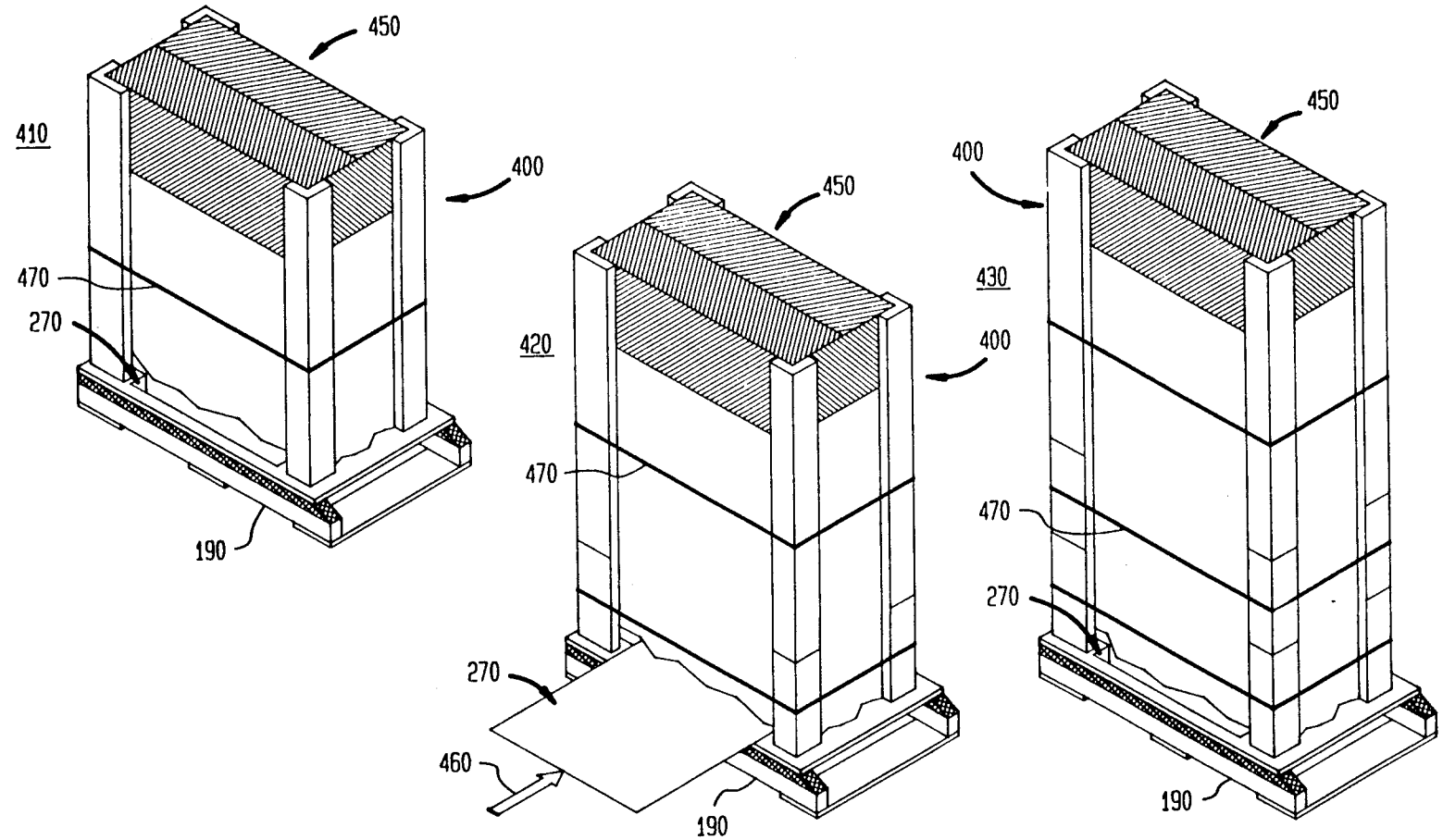
FIG. 6 shows, in pictorial form, the use of the embodiment of FIG. 2 to transport various configurations of a telecommunications switch and attendant materials.

FIG. 6 shows how pallet 190 of FIG. 2 is used to transport various configurations of a telecommunications switch and attendant materials. As shown in FIG. 6, inventive pallet 190 may be used to transport: (a) configuration 410 comprised of one shelf of equipment and accessory kit 450; (b) configuration 420 comprised of two shelves of equipment and accessory kit 450; and (c) configuration 430 comprised of three shelves of equipment and accessory kit 450. This result is obtained because bolts 231-234 which pass through cushions 225 and 226 provide adequate support against buckling and, as a result, permit the same amount of cushion material to be used to transport these three configurations. Further, as shown in FIG. 6, ramp 270 is stored under the equipment by inserting it thereunder along the direction shown by arrow 460. Lastly, the equipment is supported on pallet 190 by use of fluted corrugated fiber board corner posts 400 built, for example, to a thickness of one inch and by securing the corner posts by wire strips like strip 470.

Figure 7:
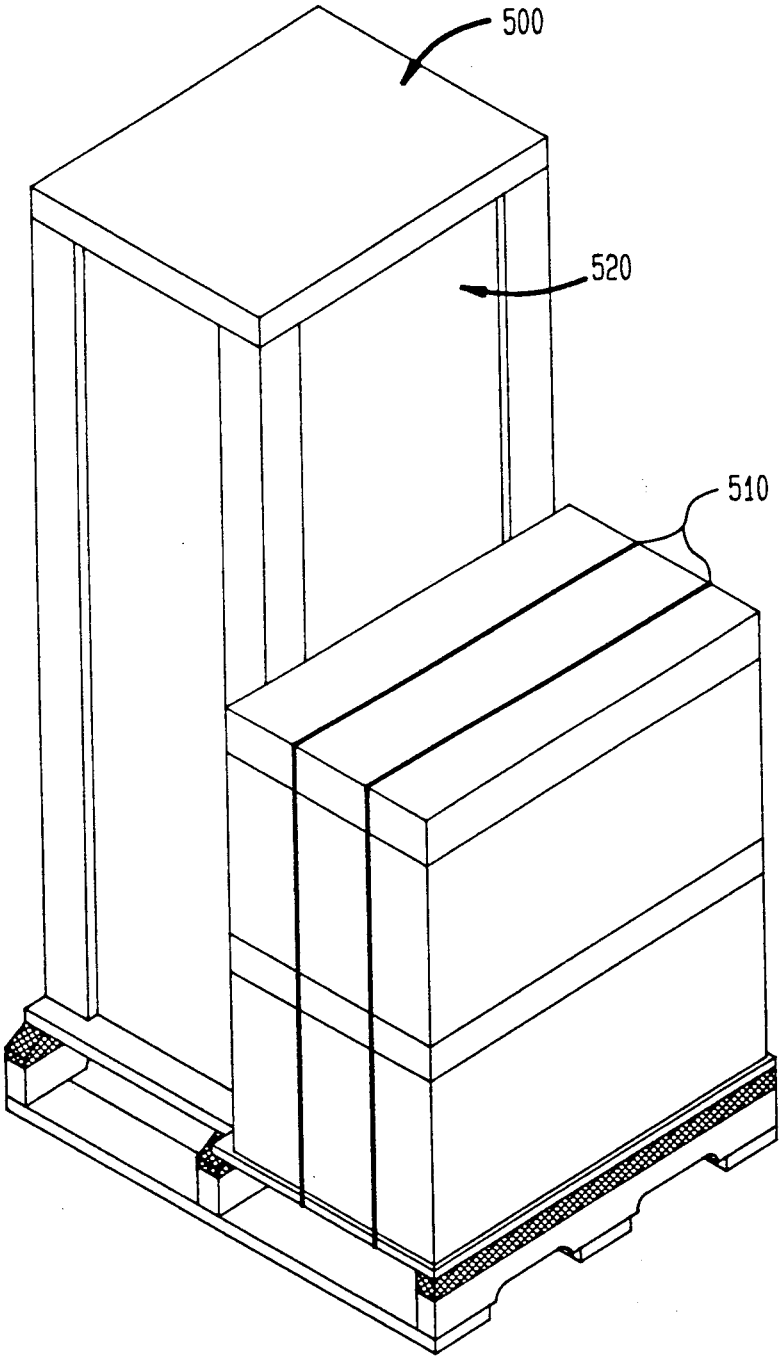
FIG. 7 shows, in pictorial form, the use of the embodiment of FIG. 5 to transport another type of telecommunications switch and attendant materials.

FIG. 7 shows how pallet 300 of FIG. 5 is used to transport another type of telecommunications switch and attendant materials. As shown in FIG. 7, the taller parts of the equipment are covered by cardboard cap 500 and the taller parts are surrounded by stretch wrap material 520. In addition, the shorter parts of the equipment are secured by wire strips 510.

Those skilled in the art recognize that further embodiments of the present invention may be made without departing from its teachings.

What is claimed is:

1. Pallet for use in transporting materials, which pallet comprises:

a first and a second stringer, a first and a second cushion, and a deck;

the first cushion being disposed between the deck and the first stringer so that the first cushion covers the first stringer;

the second cushion being disposed between the deck and the second stringer so that the second cushion covers the second stringer; and means, extending through the first cushion, for affixing the deck to the frist stringer and means, extending through the second cushion, for affixing the deck to the second stringer.

2. The pallet of claim 1 wherein the means for affixing is a bolt means.

3. The pallet of claim 1 wherein the cushion is further affixed to the stringer.

4. The pallet of claim 3 wherein the cushion is further affixed to the deck.

5. The pallet of claim 2 wherein the deck is comprised of plywood.

6. Pallet for use in transporting materials, which pallet comprises:

a first and a second stringer, a first and a second cushion, and a deck;

the first cushion being disposed between the deck and the first stringer so that the first cushion covers the first stringer;

the second cushion being disposed between the deck and the second stringer so that the second cushion covers the second stringer; and means, extending through the first cushion, for affixing the deck to the first stringer and means, extending through the second cushion, for affixing the deck to the second stringer;

wherein the deck does not fully cover the cushions and one end of each of the cushions is wedge shaped.

7. The pallet of claim 6 wherein the wedge further comprises means for attaching a ramp means.

* * * * *